US007156039B2

(12) United States Patent
Charnock et al.

(10) Patent No.: US 7,156,039 B2
(45) Date of Patent: Jan. 2, 2007

(54) KEEL GUIDE SYSTEM

(75) Inventors: Robert Alan Charnock, Houston, TX (US); Amrik Singh Nijjar, Houston, TX (US); Marcus Alan Smedley, Mesquite, TX (US); Juan Carlos Gillen, San Jose (CR)

(73) Assignee: FMC Technologies, Inc., Houston, TX (US)

( * ) Notice: Subject to any disclaimer, the term of this patent is extended or adjusted under 35 U.S.C. 154(b) by 34 days.

(21) Appl. No.: 10/687,067

(22) Filed: Oct. 16, 2003

(65) Prior Publication Data

US 2004/0079271 A1 Apr. 29, 2004

Related U.S. Application Data

(60) Provisional application No. 60/419,992, filed on Oct. 21, 2002.

(51) Int. Cl.
*B63B 21/24* (2006.01)

(52) U.S. Cl. ..... 114/293; 166/350; 405/224.3

(58) Field of Classification Search ..... 166/349, 166/342, 241.1, 350, 355, 362; 405/224.2, 405/195.1, 202, 224, 224.3, 224.4
See application file for complete search history.

(56) References Cited

U.S. PATENT DOCUMENTS

| | | | | |
|---|---|---|---|---|
| 4,071,085 | A * | 1/1978 | Grable et al. | 166/84.4 |
| 4,971,148 | A * | 11/1990 | Roche et al. | 166/88.1 |
| 5,873,677 | A * | 2/1999 | Davies et al. | 405/195.1 |
| 6,260,625 | B1 | 7/2001 | Phan et al. | 166/355 |
| 6,644,409 | B1 | 11/2003 | Stromberg et al. | 166/349 |
| 6,648,074 | B1 * | 11/2003 | Finn et al. | 166/350 |
| 6,746,182 | B1 * | 6/2004 | Munk et al. | 405/224.2 |
| 2002/0009336 | A1 * | 1/2002 | Munk et al. | 405/224.2 |
| 2004/0234344 | A1 * | 11/2004 | Munk et al. | 405/224 |

FOREIGN PATENT DOCUMENTS

| | | |
|---|---|---|
| EP | 1359288 | 11/2003 |
| GB | 2356229 | 5/2001 |
| WO | 00/01894 | 1/2000 |

* cited by examiner

*Primary Examiner*—Ed Swinehart
(74) *Attorney, Agent, or Firm*—Williams, Morgan & Amerson, P.C.

(57) ABSTRACT

A technique for guiding a riser in an offshore environment. The technique utilizes a keel guide that permits the passage of connectors or other components therethrough. A bushing is mounted within the keel guide to guide the relative linear motion of the riser assembly through the keel guide.

25 Claims, 15 Drawing Sheets

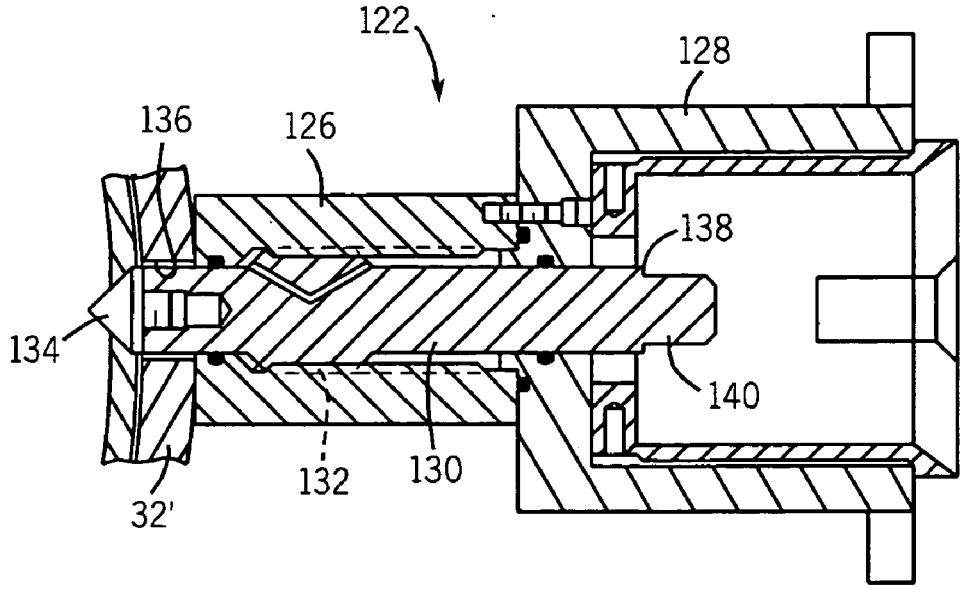
FIG. 11
FIG. 12
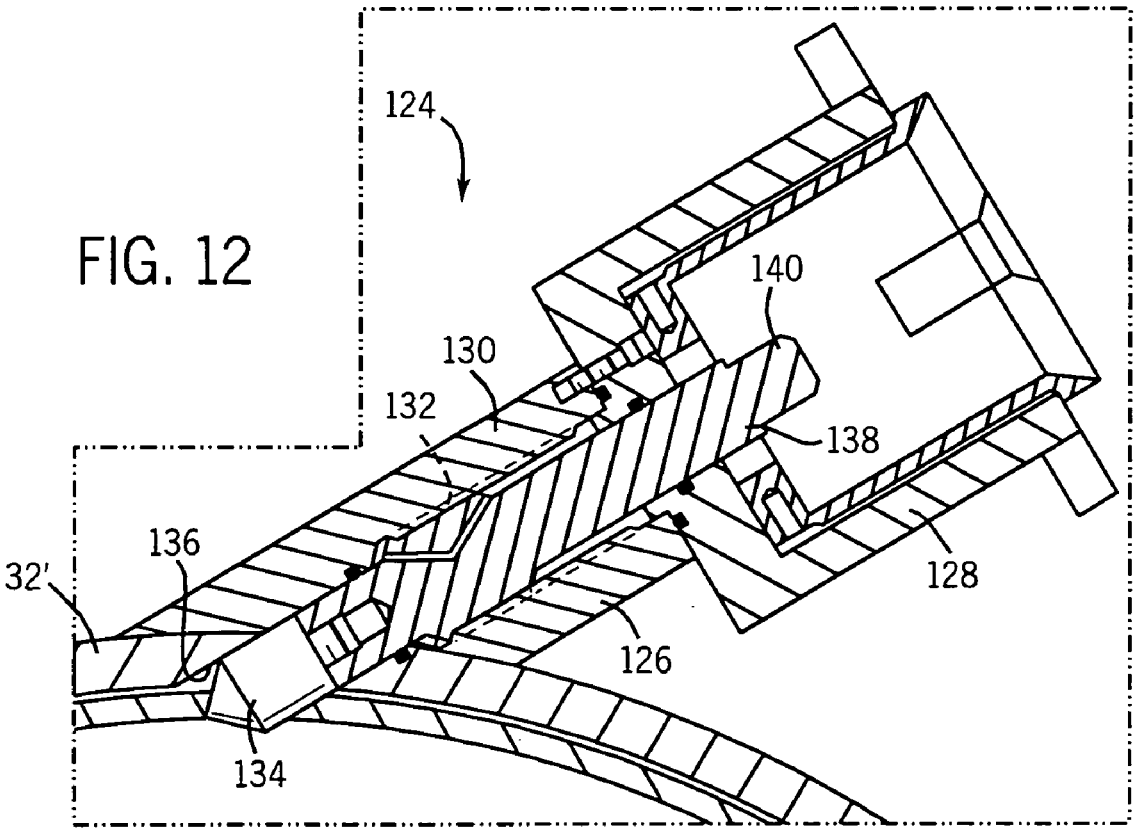

KEEL GUIDE SYSTEM

CROSS-REFERENCE TO RELATED APPLICATION

This application claims priority to Provisional Application Ser. No. 60/419,992, filed on Oct. 21, 2002, which is hereby incorporated by reference in its entirety for all purposes.

BACKGROUND OF THE INVENTION

In certain offshore applications, keel guides are mounted to various vessels or platforms to guide risers extending to subsea locations. The keel guides restrain the upper end of the risers against lateral motion, thus preventing the risers from interfering with each other or with the vessel or platform. Generally, a keel guide comprises a cylindrical member or "can" which is attached to the hull of the vessel or platform with an appropriate bracket.

Risers are permitted to move vertically within the keel guide to compensate for motion of the vessel or platform. Each riser is equipped with a keel joint designed to ride within the keel guide. Generally, the keel joint comprises a pipe section of increased thickness to withstand the bending loads exerted on the joint by the keel guide. The keel joint may be provided with an outer wear sleeve along the portion of the joint which contacts the keel guide.

In many applications, a tieback connector is coupled to a lower end of the riser and moved to the seabed as the riser is lowered. However, such connectors may tend to be too large to pass through the keel guide of nominal size. Accordingly, the riser is run outside of or offset from the keel guide and moved into the keel guide in a later procedure. In some applications, for example, the keel guide is formed with a slot, and once the connector has passed the keel guide, the vessel or platform is translated toward the riser until the riser passes through the slot and into the keel guide. The riser is then moved vertically until the keel joint enters the keel guide. The outer diameter of the keel joint is larger than the width of the slot to restrain the keel joint within the keel guide.

In some applications, the riser is lowered until the tieback connector is below the keel guide. At this point, the vessel or platform is translated, until the riser moves through the slot in the keel guide. The riser is then lowered and positioned until the keel joint is within the keel guide, the riser is tensioned and the keel joint remains positioned in the keel guide.

Translation of the vessel or platform to the riser coupled with subsequent movement of the keel joint into the keel guide is a costly and time-consuming process. Additionally, such an approach typically requires the cutting of a slot into the platform structure of sufficient width to permit the passing of the riser from a position external to the keel guide to a position within the keel guide.

SUMMARY

The present invention relates generally to a technique for guiding a riser in an offshore environment. The technique utilizes a bushing assembly that may be selectively landed within a keel guide. The bushing assembly also comprises an opening sufficient to permit relative linear movement of the riser therethrough. The bushing assembly allows the use of a keel guide with a larger diameter, e.g. sufficient to permit the passing of a tieback connector, while still guiding linear movement of the riser within the keel guide.

BRIEF DESCRIPTION OF THE DRAWINGS

Certain exemplary embodiments of the invention will hereafter be described with reference to the accompanying drawings, wherein like reference numerals denote like elements, and:

FIG. 11 is a cross-sectional view of a plumb mounted lock-down pin assembly taken generally along line 11—11 of FIG. 9;

FIG. 12 is a cross-sectional view similar to FIG. 11, but showing an obliquely mounted lock-down pin assembly;

DETAILED DESCRIPTION OF EXEMPLARY EMBODIMENTS

Figure 1:
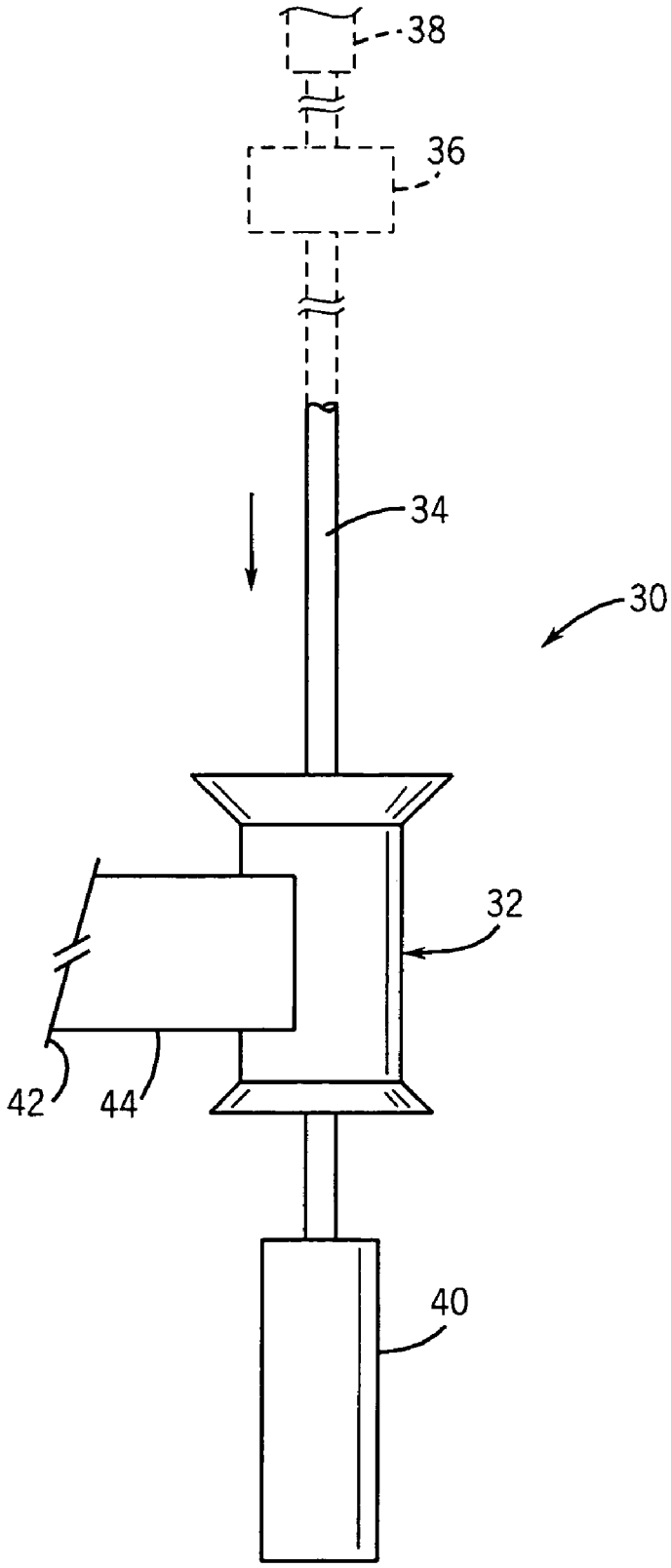
FIG. 1 is a front elevational view of a riser being installed in a keel guide, according to an embodiment of the present invention.

Referring generally to FIG. 1, an exemplary embodiment of a keel guide system 30 is illustrated. Keel guide system 30 comprises a keel guide 32, a riser assembly 34 and a bushing 36 to be selectively landed in keel guide 32. In at least one embodiment, riser assembly 34 comprises a keel joint 38, and bushing 36 is temporarily coupled to riser assembly 34 at or below keel joint 38. As riser assembly 34 is moved downwardly through keel guide 32, bushing 36 lands in keel guide 32 and is released from riser assembly 34 to permit keel joint 38 to slide in a linear direction within an opening 39 formed axially through bushing 36.

In the embodiment illustrated, keel guide system 30 also comprises a connector 40, such as a tieback connector. Keel guide 32 is sized to permit the passage of connector 40 as riser assembly 34 is fed downwardly towards the subsea floor. Additionally, keel guide 32 may be attached to a structure 42 which, by way of example, comprises a hull of a vessel or a platform used in an offshore application. In various embodiments, the vessel or platform may include, but are not limited to, a spur platform or a tension leg platform (TLP). Keel guide 32 is attached to the vessel or platform via an appropriate bracket 44.

Figure 2:
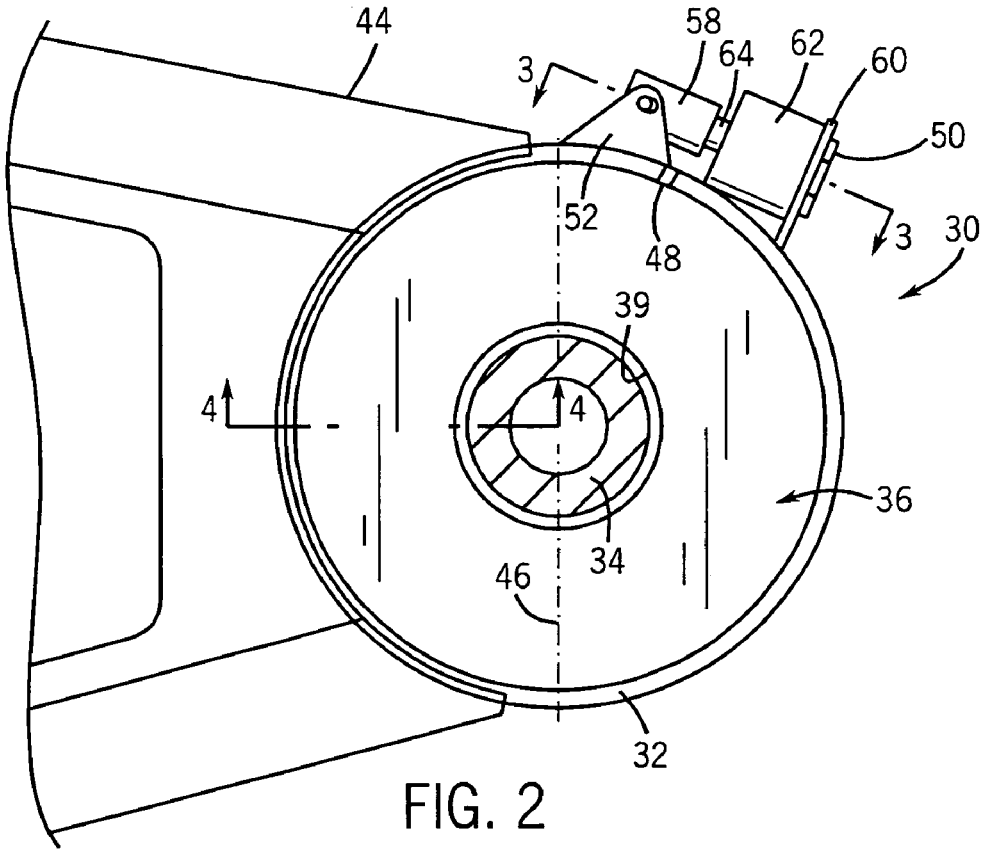
FIG. 2 is a top view of a keel guide, according to one embodiment of the present invention.

One embodiment of keel guide system 30 is illustrated in FIG. 2. In this embodiment, keel guide 32 is mounted to a vessel or platform by bracket 44. An inner diameter 46 of keel guide 32 is sufficiently large to allow passage of tieback connector 40 or other component attached to the bottom of riser assembly 34.

As illustrated, keel guide 32 comprises a side opening 48 that extends the longitudinal length of keel guide 32. Side opening 48 allows keel guide 32 to be opened and closed a slight amount to increase or decrease the effective internal diameter 46 of keel guide 32. A locking device 50, such as a band-type locking device, is coupled to keel guide 32 to open or close the keel guide 32.

Figure 3:
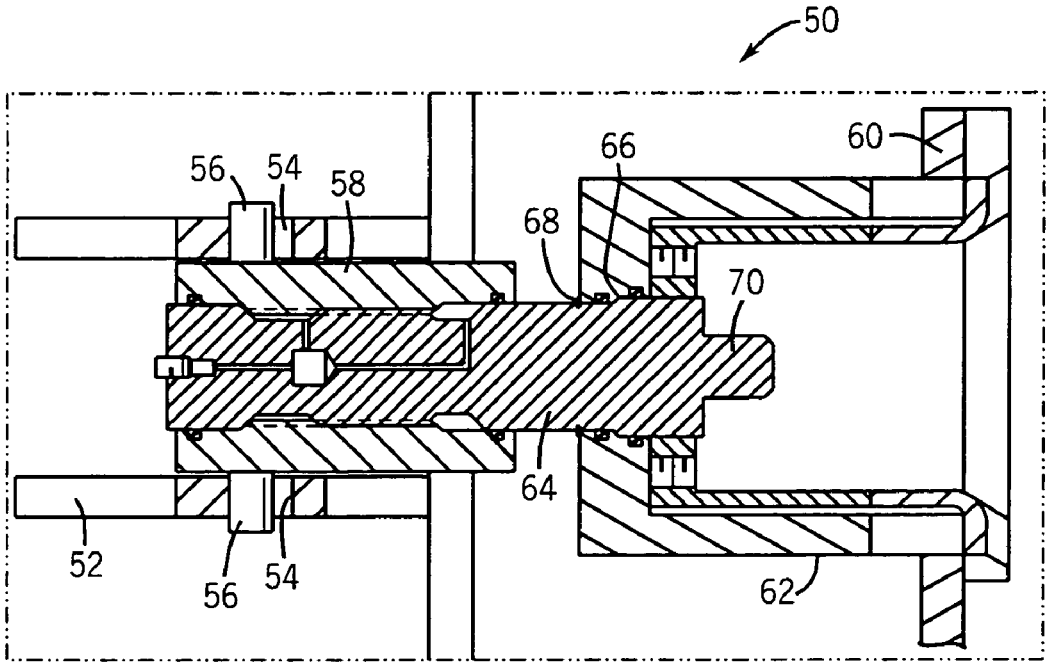
FIG. 3 is a cross-sectional view taken generally along line 3—3 of FIG. 2.

One exemplary locking device 50 is illustrated in cross-section in FIG. 3. In this embodiment, locking device 50 comprises a pivot bracket 52 attached to keel guide 32 by, for example, welding or other appropriate fastener, on one side of opening 48. Pivot bracket 52 comprises a pair of slots 54 for receiving corresponding pins 56 extending from a pivot sleeve 58.

A second bracket 60 is attached to keel guide 32 by welding or other appropriate fastener on a side of opening 48 opposite pivot bracket 52. Second bracket 60 comprises a remote operated vehicle ("ROV") bucket 62. A stem 64 is coupled between pivot sleeve 58 and bucket 62 and extends across side opening 48. Stem 64 may be threadably engaged with pivot sleeve 58 and retained against movement relative to ROV bucket 62 by a shoulder 66 and a retaining ring 68. Stem 64 further comprises a head 70 that extends into ROV bucket 62. Head 70 is adapted for engagement and rotation by an ROV manipulator to selectively increase or decrease the width of side opening 48 and thus the diameter 46 of keel guide 32.

Figure 4:
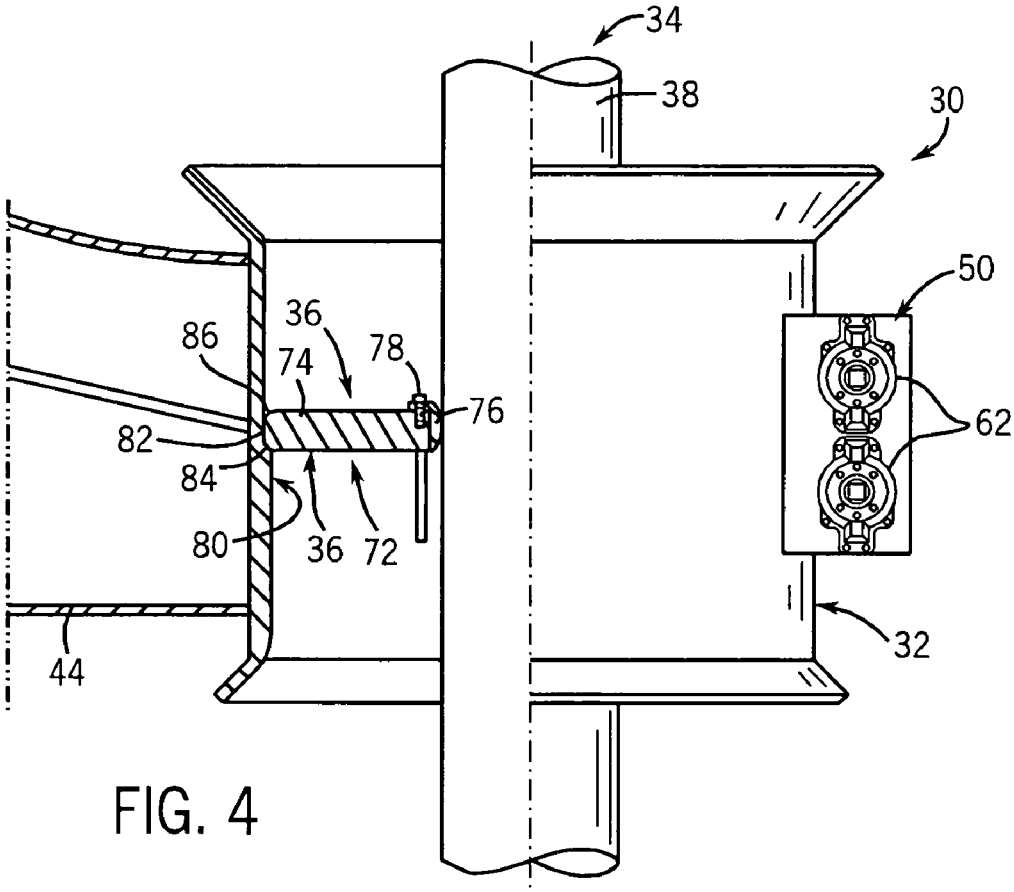
FIG. 4 is a partial cross-sectional view taken generally along line 4—4 of FIG. 2.

Referring generally to FIG. 4, in this embodiment, bushing 36 comprises a wear bushing assembly 72 disposed in an annular space between keel guide 32 and keel joint 38. Wear bushing assembly 72 has a bushing member 74 and a plurality of wear members 76. Wear members 76 may be attached to bushing member 74 by fasteners, such as screws 78 and are oriented to bear against keel joint 38, as illustrated. Thus, wear members 76 may be replaced due to, for example, sacrificial wear. In other embodiments, wear members 76 may comprise coatings or other types of hardened surfaces, e.g. hard facing, to reduce the detrimental effects of wear. The coating may be formed of a hardened metal or a nonmetallic material applied to bushing member 74.

Bushing 36 is selectively received and held within keel guide 32 by a retention or landing mechanism 80. An exemplary landing mechanism 80 comprises a landing feature 82, e.g. a groove, defined by a lower shoulder 84 and an upper shoulder 86. Bushing member 74 is received in landing feature 82 and is retained against axial movement by lower shoulder 84 and upper shoulder 86.

Figure 5:
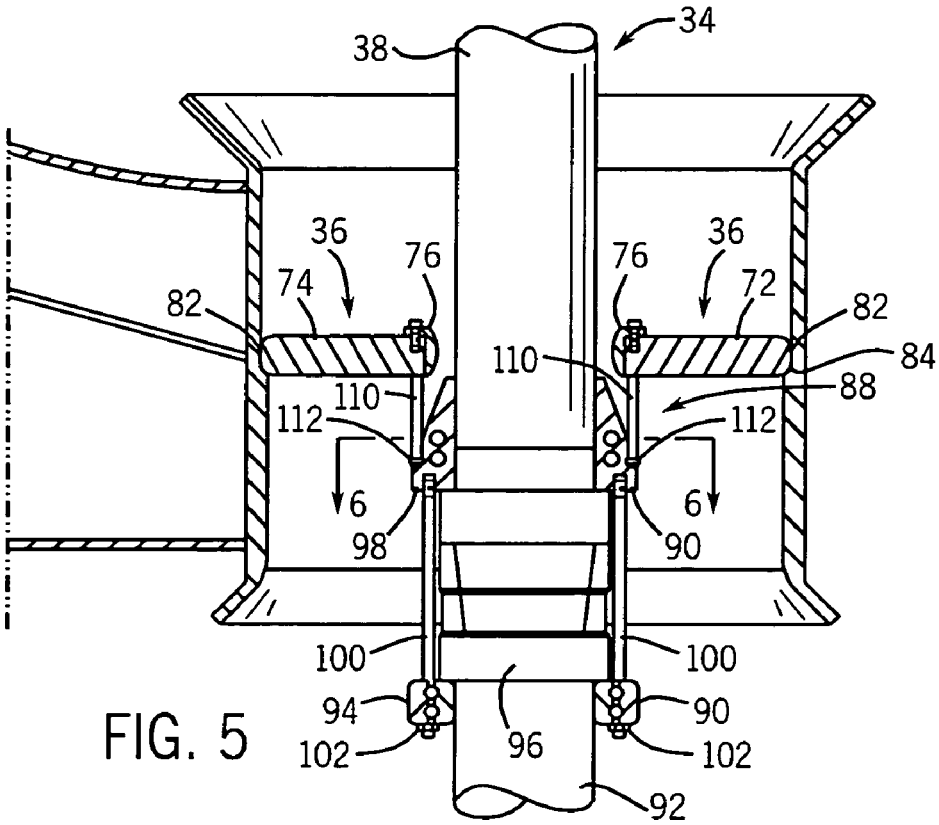
FIG. 5 illustrates one embodiment of a bushing being installed in a keel guide.

To facilitate landing of bushing 36 in keel guide 32, bushing 36 may be temporarily attached to riser assembly 34 by a mounting mechanism 88 as illustrated in FIG. 5. One exemplary mounting mechanism 88 comprises a clamp connector 90 which connects wear bushing assembly 72 to riser assembly 34 generally at the junction between keel joint 38 and a next lower riser section 92. A lower clamp 94 is secured below a flange 96 disposed on lower riser section 92. An upper clamp 98 is secured above flange 96 on keel joint 38. Lower clamp 94 is secured to upper clamp 98 by a plurality of tie rods 100 and corresponding fasteners, such as nuts 102.

Figure 6:
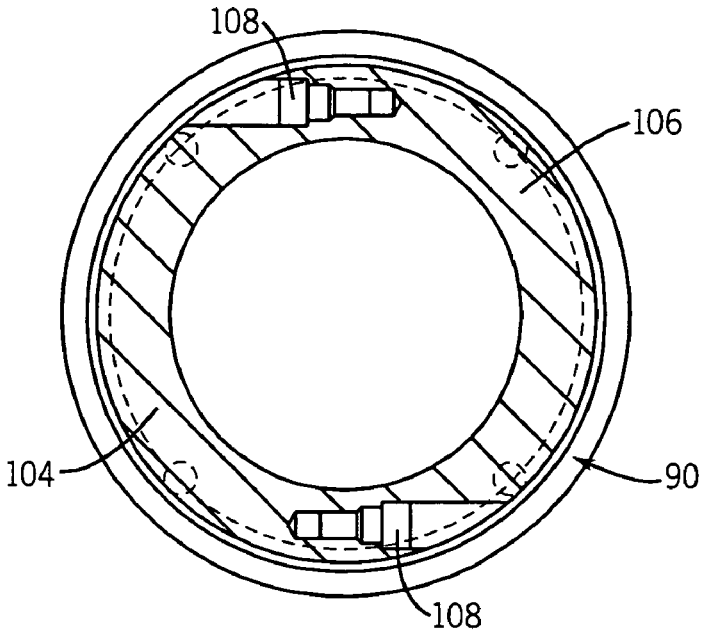
FIG. 6 is a cross-sectional view taken generally along line 6—6 of FIG. 5.

As illustrated in FIG. 6, lower clamp 94 and upper clamp 98 may each comprise semicircular halves 104 and 106 that are secured around riser assembly 34 by one or more appropriate fasteners 108, such as screws. Clamp connector 90 is secured to wear bushing assembly 72 by posts 110. In the specific embodiment illustrated, posts 110 extend from wear bushing assembly 72 to upper clamp 98 and are secured to upper clamp 98 by shear pins 112 (see FIG. 5).

Prior to running riser assembly 34, the locking device 50 on keel guide 32 is actuated via, for example, an ROV to open keel guide 32 to a position where the inner diameter 46 above landing feature 82 is slightly larger than the outside diameter of bushing 36. The inside diameter below landing feature 82 remains slightly smaller that the outside diameter of bushing 36. As bushing 36 is lowered into keel guide 32, bushing assembly 72 lands on lower shoulder 84. As the riser assembly 34 is further lowered, the weight of the riser assembly causes the shearing of shear pins 112. The riser assembly 34 then continues downward and leaves bushing 36 retained in keel guide 32. Locking device 50 may then be actuated to close keel guide 32 such that upward, linear movement of bushing 36 is prevented by the interfering engagement of upper shoulder 86 with bushing member 74.

Figure 7:
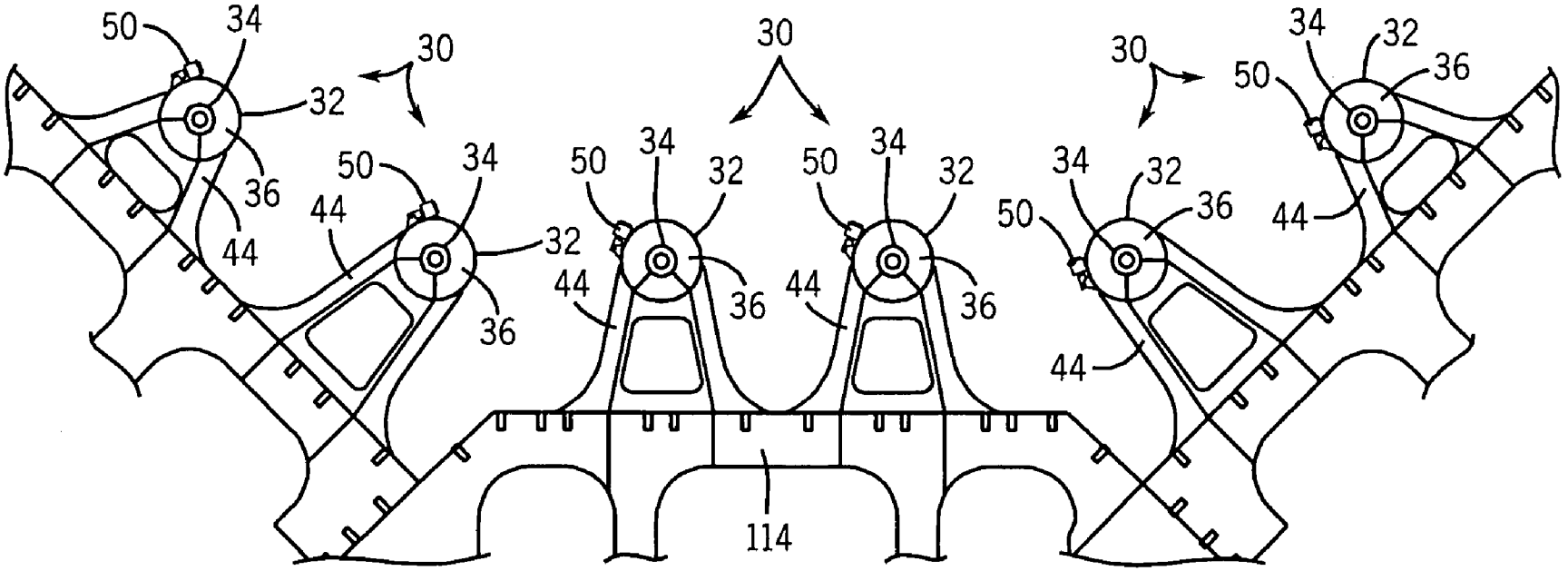
FIG. 7 is a top view of an embodiment utilizing several keel guides arranged on a hull.

In an exemplary application, a plurality of keel guides 32 are attached to a structure such as a hull 114 of a vessel or platform, as illustrated in FIG. 7. The locking devices 50 on each keel guide are oriented for accessibility by an ROV. By using bushings 36 in each keel guide 32, connectors or components can be moved downwardly through the center of each keel guide during installation, and the corresponding keel guides 32 and bushings 36 cooperate to prevent the riser assemblies 34 from interfering with each other or hull 114 upon installation.

Figure 8:
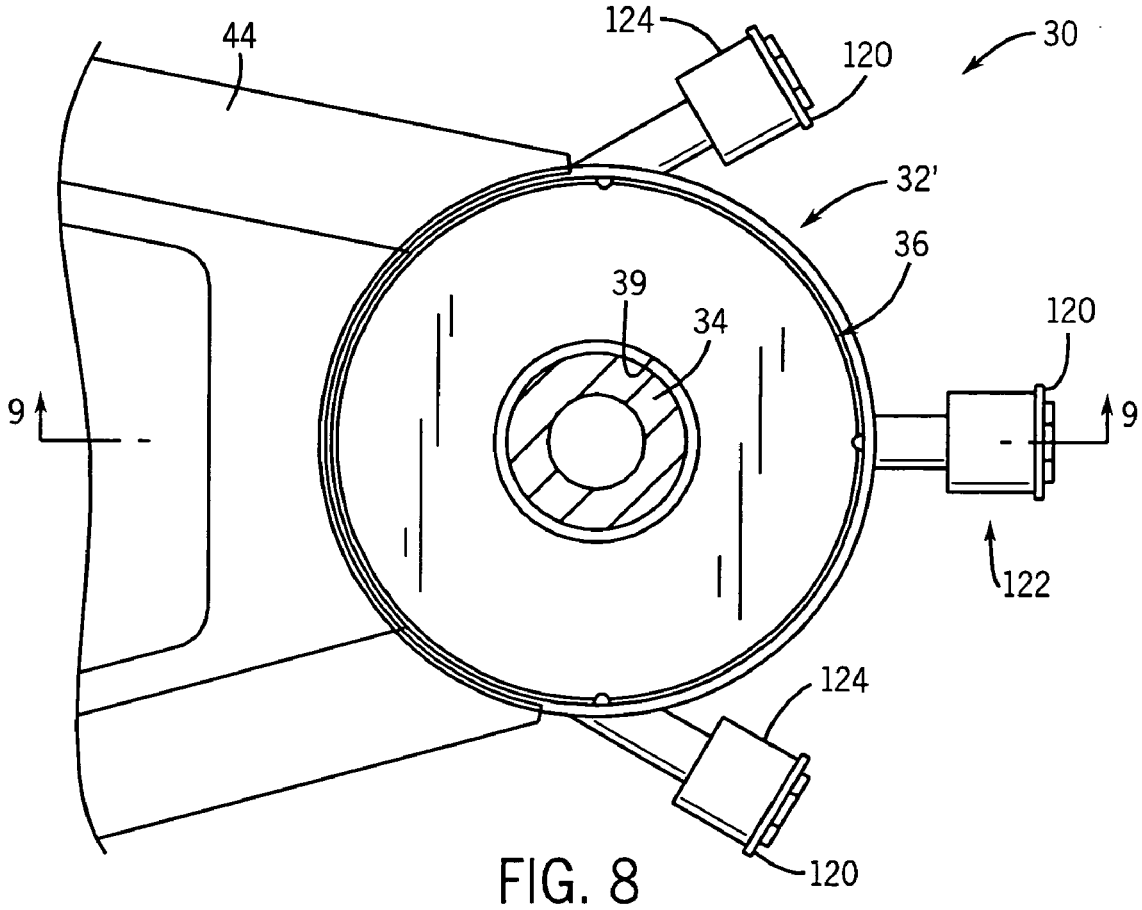
FIG. 8 is a top view of another embodiment of a keel guide having retractable pins for retaining a bushing.
Figure 9:
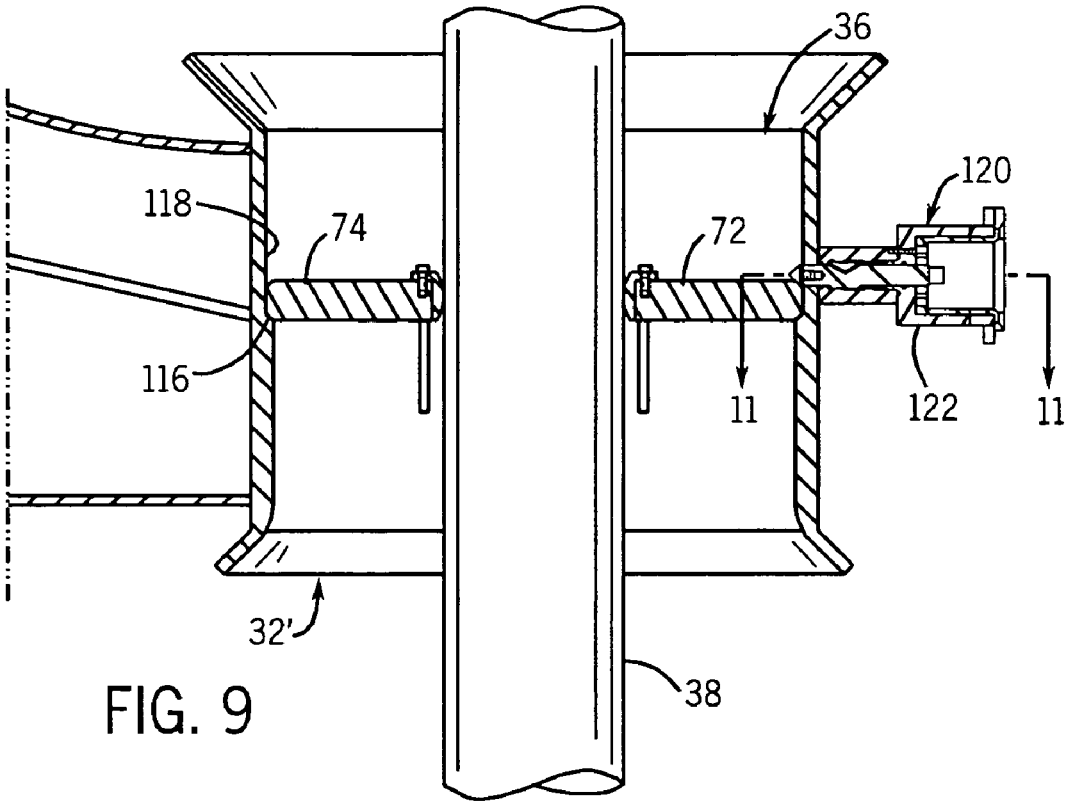
FIG. 9 is a side cross-sectional view taken generally along line 9—9 of FIG. 8.
Figure 10:
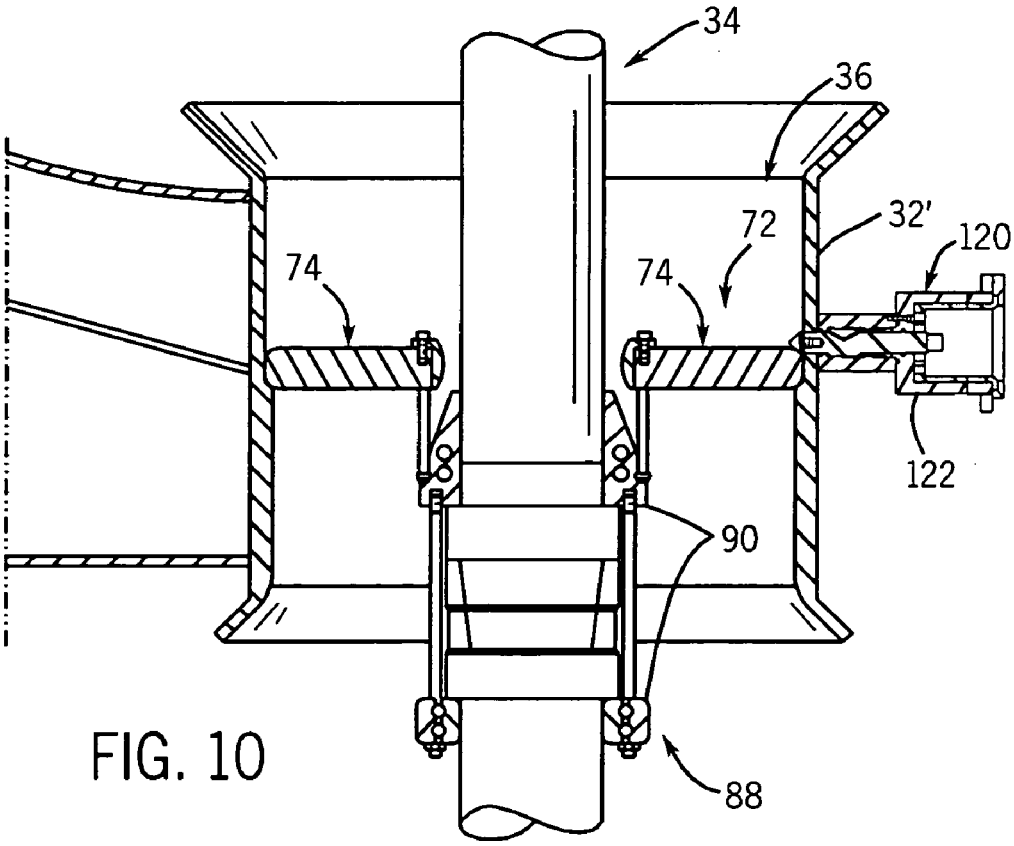
FIG. 10 illustrates a guide bushing being installed in a keel guide as illustrated in FIG. 8.

Another embodiment of keel guide system 30 is illustrated in FIGS. 8 through 10. A keel guide 32' is coupled to a structure, such as the hull of a vessel or a platform, via bracket 44. As described above, the inner diameter of the keel guide is large enough to allow passage of a tieback connector or other component attached to the bottom of riser assembly 34. In this embodiment, bushing 36 is landed on a shoulder 116 formed along an interior surface 118 of keel guide 32'. Interior surface 118 has a slightly greater diameter than the remainder of keel guide 32' to permit bushing 36 to move downwardly to shoulder 116 without the use of an expandable side opening.

In the embodiment illustrated, wear bushing assembly 72, and specifically bushing members 74, is held against shoulder 116 by one or more lock-down assemblies 120. Lock-down assemblies 120 may be mounted in a variety of orientations, such as the exemplary plumb mounted lock-down assembly 122 and the obliquely mounted assemblies 124, illustrated best in FIG. 8. Lock-down assemblies 120 may be used selectively to prevent upward linear motion of bushing 36 once landed against shoulder 116, as illustrated in FIGS. 9 and 10. Specifically, once bushing 36 is landed in keel guide 32', either or both lock-down assemblies 122 and 124 may be actuated by, for example, an ROV to retain bushing 36 against linear motion within keel guide 32'. As illustrated best in FIG. 10, a temporary mounting mechanism 88 and corresponding clamp connector 90 may be used to temporarily hold bushing 36 in place with respect to riser assembly 34 while being lowered into keel guide 32'.

Exemplary embodiments of a plumb mounted lock-down assembly 122 and an obliquely mounted lock-down assembly 124 are illustrated in FIGS. 11 and 12, respectively. Each lock-down assembly comprises a sleeve 126 which is attached to keel guide 32' by an appropriate fastening method, such as welding. Each lock-down assembly further comprises an ROV bucket 128 attached to an end of sleeve 126 generally opposite keel guide 32'. A lock-down pin 130 is threadably engaged with sleeve 126 at an internal threaded region 132. A first end 134 of lock-down pin 130 extends into a keel guide opening 136. As pin 130 is threaded inwardly, the first end 134 moves into the interior of keel guide 32' to prevent upward movement of bushing 36. In the plumb mounted lock-down assembly 122, opening 136 is generally radially directed, while opening 136 of obliquely mounted lock-down assembly 124 is oriented at an angle with respect to the radius, as illustrated in FIG. 12. First end 134 may have a variety of configurations, but one exemplary configuration is a conical tip.

An opposite end 138 of lock-down pin 130 extends into ROV bucket 128 and terminates at a head 140. Head 140 is adapted for engagement by an external device, such as an ROV manipulator.

Figure 13:
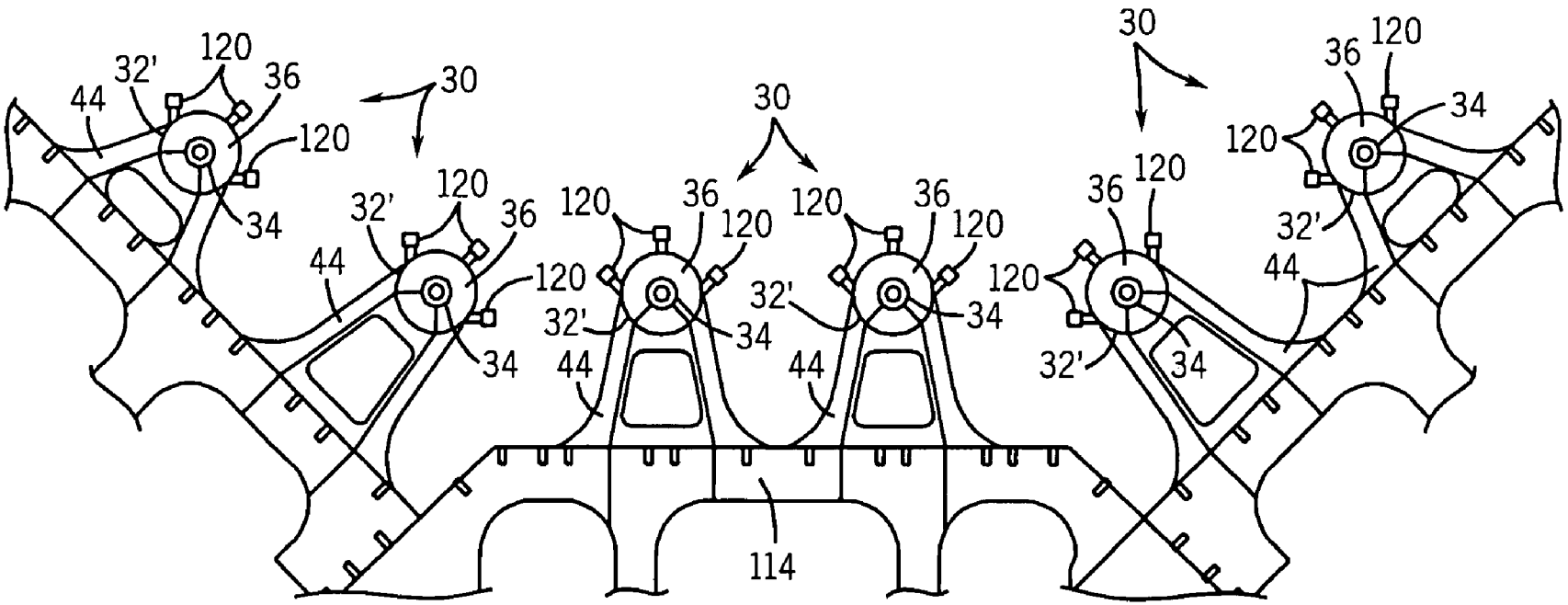
FIG. 13 is a top view of a plurality of keel guides of the type illustrated in FIG. 8, arranged on a hull.

One exemplary application of keel guide system 30 in which keel guide 32' is utilized is illustrated in FIG. 13. In this example, a plurality of keel guides 32' are attached to hull 114 by appropriate brackets 44. Each of the keel guides comprises a plurality of lock-down assemblies 120 oriented for access by an ROV. Thus, the riser assemblies 34 with attached connectors or other components may be run through corresponding keel guides 32' until each bushing 36 is landed therein. Upon release, e.g. fracturing, of the temporary mounting mechanism 88, each riser assembly slides linearly downward through its surrounding bushing 36.

Figure 14:
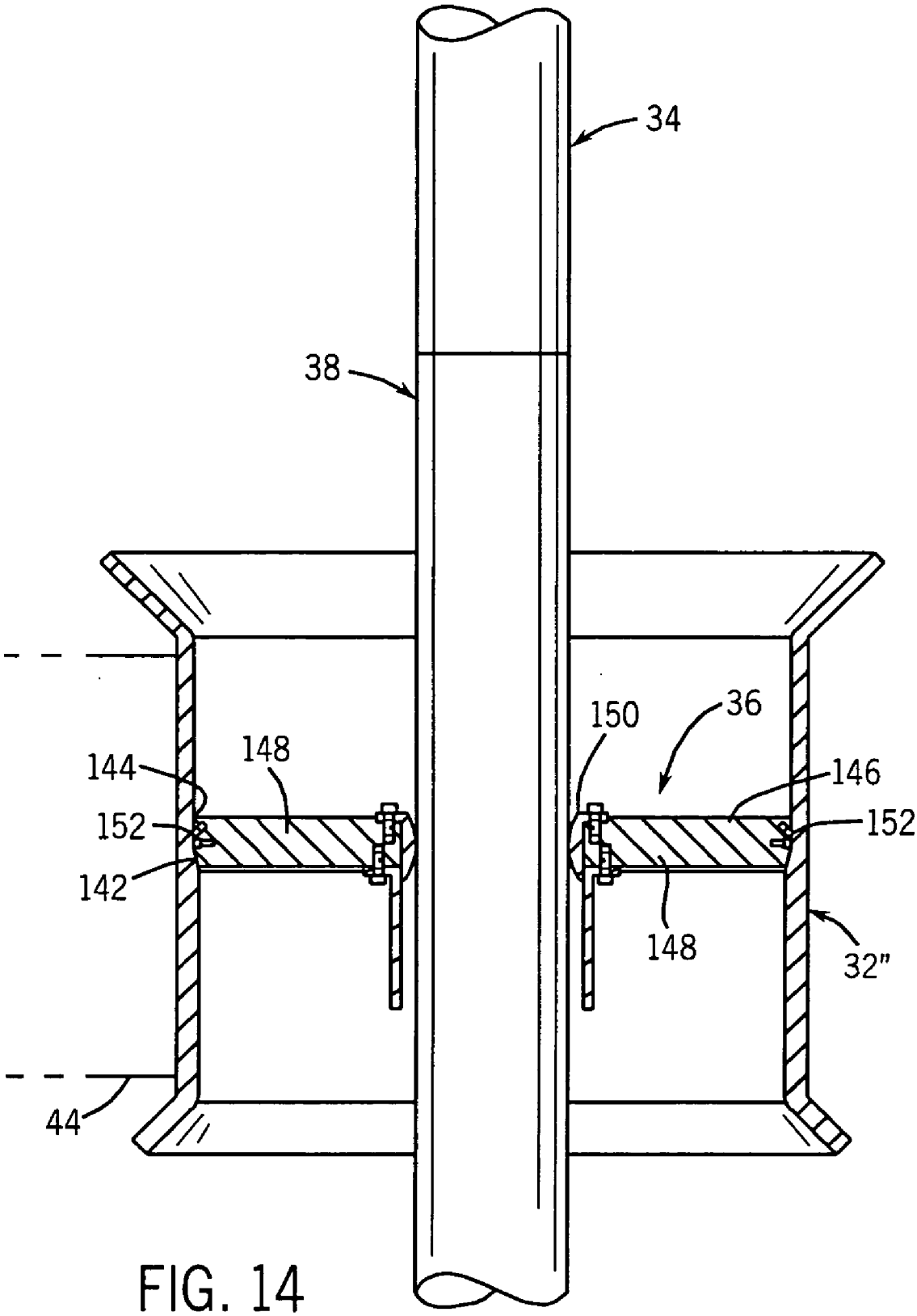
FIG. 14 is a side cross-sectional view of another embodiment of a keel guide having spring-loaded retaining pins.
Figure 15:
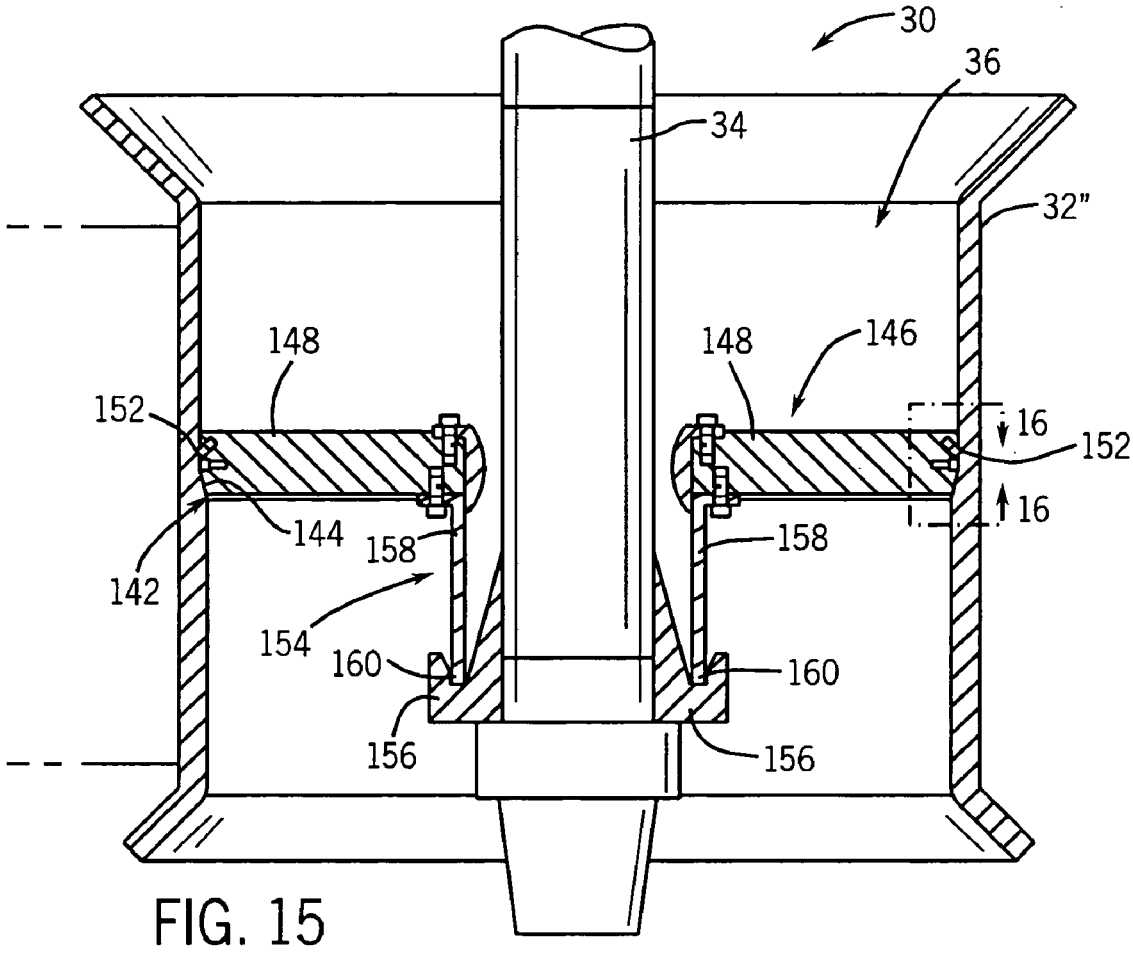
FIG. 15 is a side view of the guide bushing illustrated in FIG. 14 being installed in a keel guide.
Figure 16:
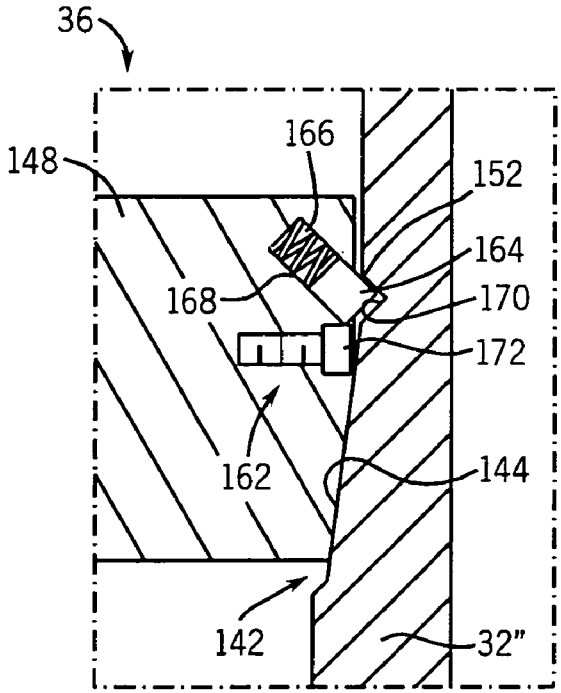
FIG. 16 is an expanded view of a spring-loaded retaining pin illustrated in FIG. 15.

Another embodiment of keel guide system 30 is illustrated in FIGS. 14 through 16. In this embodiment, a keel guide 32" is coupled to bracket 44 for connection to an appropriate structure, such as the hull of a vessel or platform. As with previously described embodiments, the inner diameter of keel guide 32" may be large enough to allow passage of a connector, such as a tieback connector, or other component attached to the bottom of riser assembly 34.

In this embodiment, bushing 36 is landed in a landing feature 142 that is in the form of bowl 144 defined by an upper interior surface of keel guide 32" (see FIG. 15). Bowl 144 is shaped to receive a wear bushing assembly 146 of bushing 36. Specifically, the exemplary wear bushing assembly 146 comprises one or more radially extending bearing members 148 having interior wear inserts 150. Wear inserts 150 are positioned to bear against keel joint 38. Additionally, wear bushing assembly 146 also comprises a plurality of retention members 152 that retain bushing 36 against upward movement within keel guide 32". In other words, the shape of bowl 144 allows wear bushing assembly 146 to move downwardly into keel guide 32" until further movement is blocked by landing feature 142. Once positioned against landing feature 142, retention members 152 may be actuated to impede upward movement of bushing 36, as illustrated in FIG. 14.

In this embodiment, bushing 36 also may comprise a temporary retention mechanism 154 by which bushing 36 is temporarily coupled to riser assembly 34 during installation of bushing 36 into keel guide 32". One exemplary retention mechanism 154 comprises a clamp connector 156 that may be clamped around riser assembly 34. Clamp connector 156 is coupled to wear bushing assembly 146 via posts 158 and shear pins 160. As riser assembly 34 is lowered through the interior of keel guide 32", bushing 36 moves with riser assembly 34 until landed in landing feature 142. The weight of riser assembly 34 shears shear pins 160, and riser assembly 34 continues downward movement through keel guide 32" while bushing 36 is retained within the keel guide. Subsequently, retention members 152 may be actuated to impede upward movement of bushing 36 with respect to keel guide 32".

One exemplary embodiment of retention mechanism 152 is illustrated in FIG. 16. In this embodiment, retention member 152 comprises a plurality of spring-loaded assemblies 162. Each spring-loaded assembly has a pin that is biased outwardly by a spring 166. Pin 164 and spring 166 may be mounted in a corresponding bore 168 formed in bearing member or members 148. Spring 166 biases pin 164 towards a retention groove 170 formed in the interior wall of keel guide 32". Once pin 164 is biased into engagement with groove 170, upward movement of bushing 36 is inhibited. A retainer, such as a screw 172, may be used to partially block bore 168 and thereby retain pin 164 within bore 168.

Figure 17:
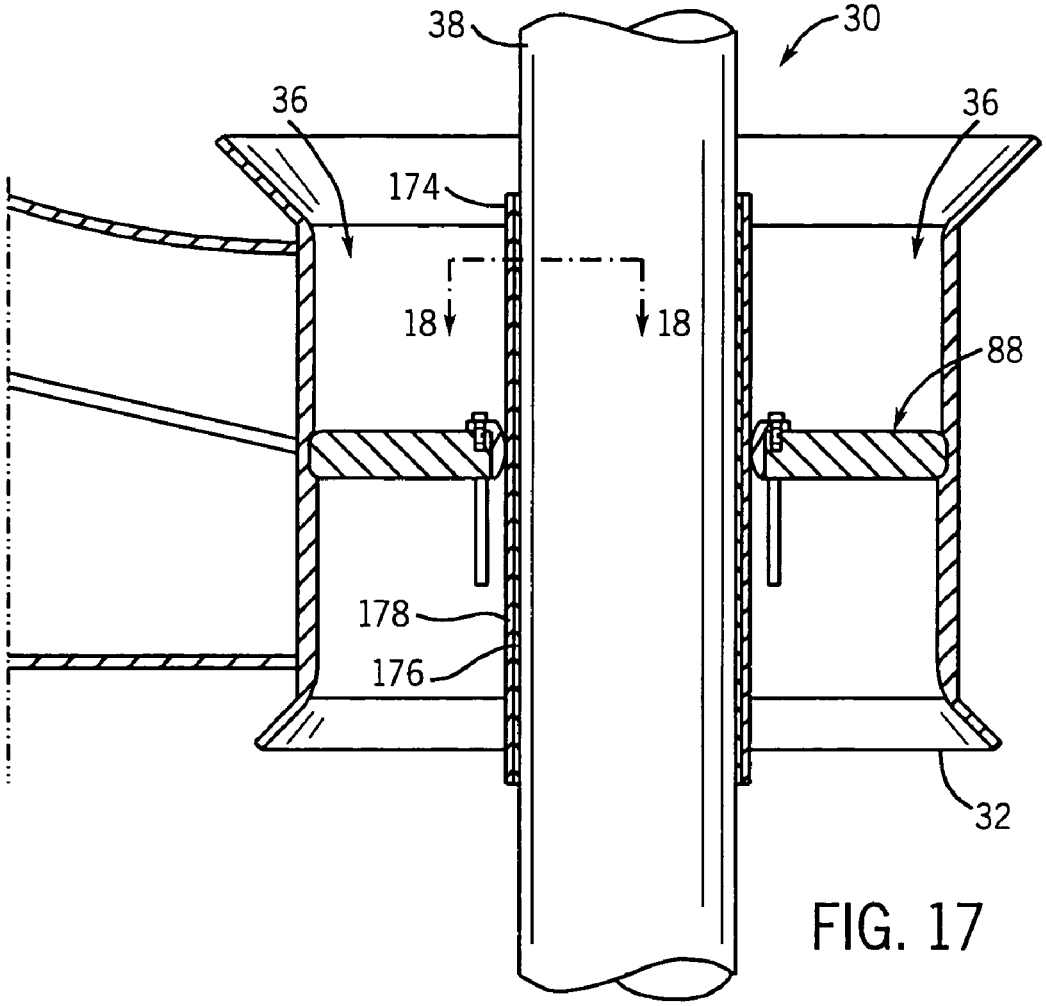
FIG. 17 is a side cross-sectional view of another embodiment of a bushing disposed within a keel guide.
Figure 18:
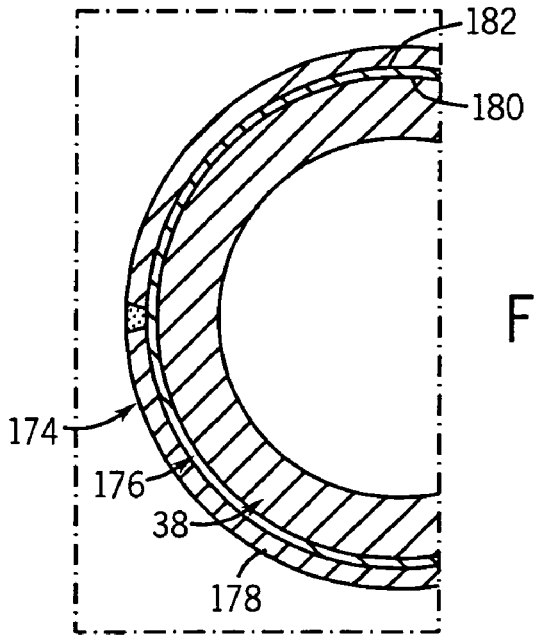
FIG. 18 is a cross-sectional view taken generally along line 18—18 of FIG. 17.

As illustrated in FIGS. 17 and 18, an external wear sleeve 174 may be utilized between bushing 36 and keel joint 38. The wear sleeve 174 may be attached to keel joint 38 by, for example, press fitting, shrink fitting or other suitable techniques. Wear sleeve 174 protects keel joint 38 from wear and damage as keel joint 38 moves within keel guide 32. In one example, wear sleeve 174 may comprise a radially inward backup ring 176 coupled to an external wear layer 178 by, for example, welding. In this example, backup ring 176 comprises a feature 180, such as a split in the material. Feature 180 can be engaged with a corresponding feature 182 on keel joint 38 to limit relative movement between keel guide 38 and wear sleeve 174. Alternatively, backup ring 176 may comprise or may be replaced with a thicker elastomeric material to enable greater flexibility within the keel guide. The thicker elastomeric material may comprise, for example, a poured or castable material, such as a foam.

Figure 19:
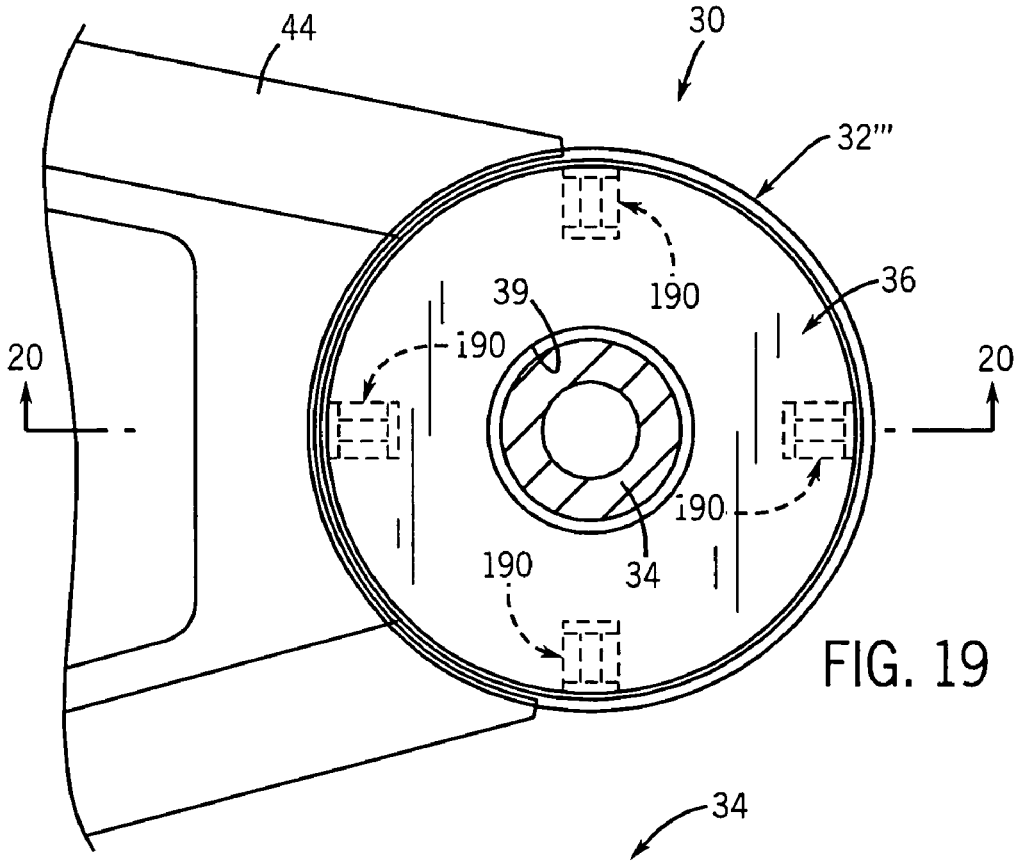
FIG. 19 is a top view of another embodiment of a keel guide having a lock-down pin assembly.
Figure 20:
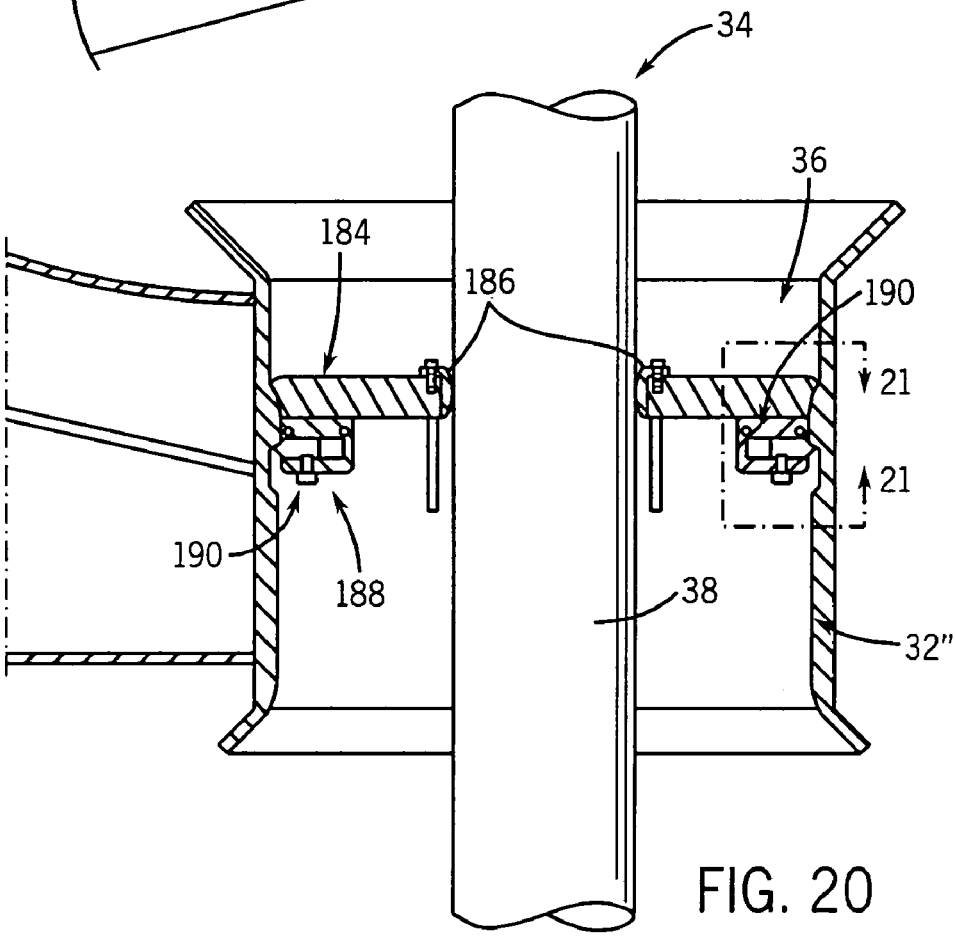
FIG. 20 is a side cross-sectional view taken generally along line 20—20 of FIG. 19.

Another embodiment of keel guide system 30 is illustrated in FIGS. 19 through 23. In this embodiment, a keel guide 32''' is mounted to a structure, such as the hull of a vessel or platform by a bracket 44. Again, the inner diameter of keel guide 32''' may be large enough to allow the passage of a connector, such as a tieback connector, or other component attached to the bottom of riser assembly 34. Bushing 36 is landed within the interior of keel guide 32''' to limit radial movement of riser assembly 34 while allowing relative linear movement between riser assembly 34 and keel guide 32'''. Bushing 36 comprises a bushing assembly 184 having at least one and typically a plurality of wear inserts 186 that bear against keel joint 38 of riser assembly 34. Additionally, a retention mechanism 188 is used to retain bushing 36 within keel guide 32''', as illustrated in FIGS. 19 and 20.

One exemplary retention mechanism 188 comprises a plurality of swinging lock-down pin assemblies 190 (see FIG. 19). Additionally, a temporary retention mechanism may be used to hold bushing 36 to riser assembly 34 during installation of bushing 36 in keel guide 32''', as with the embodiments described above. In this embodiment, the plurality of pin assemblies 190, e.g. four pin assemblies, cooperate to restrain bushing 36 against linear movement with respect to keel guide 32''' once the bushing is landed within the keel guide.

Figure 21:
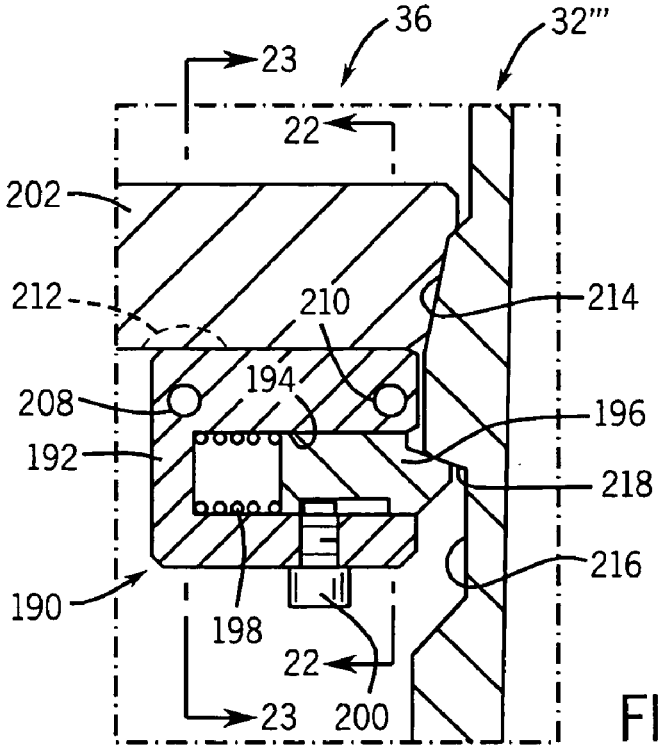
FIG. 21 is an expanded view of an embodiment of a lock-down pin assembly illustrated in FIG. 20.
Figure 22:
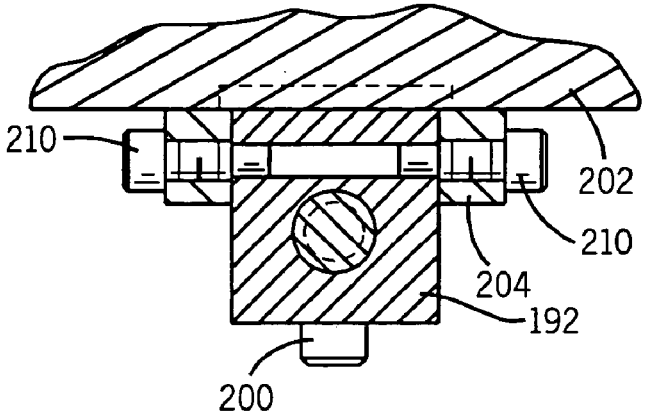
FIG. 22 is a cross-sectional view taken generally along line 22—22 in FIG. 21.
Figure 23:
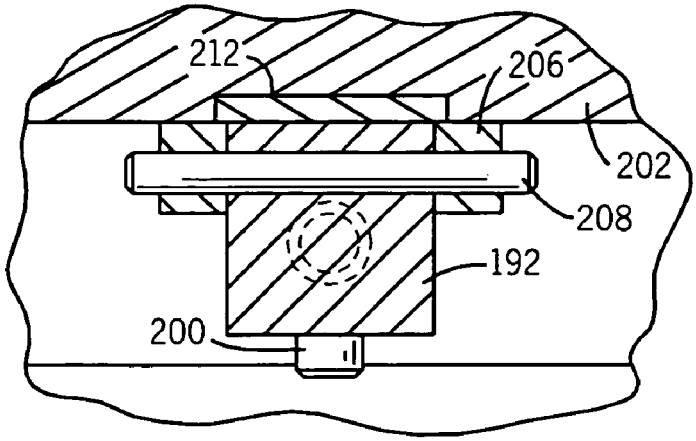
FIG. 23 is a cross-sectional view taken generally along line 23—23 in FIG. 21.
Figure 24:
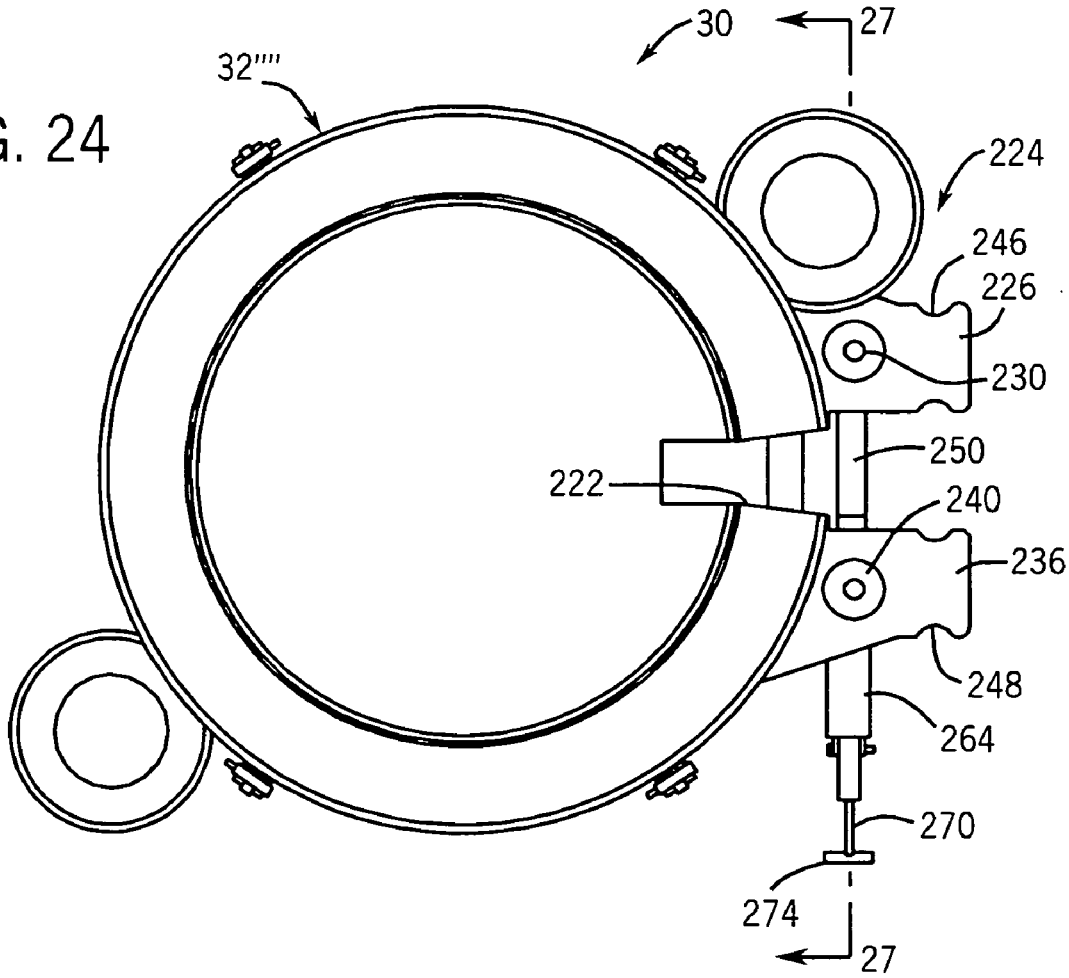
FIG. 24 is a top view of an embodiment of a keel guide system having a band-type locking device.
Figure 25:
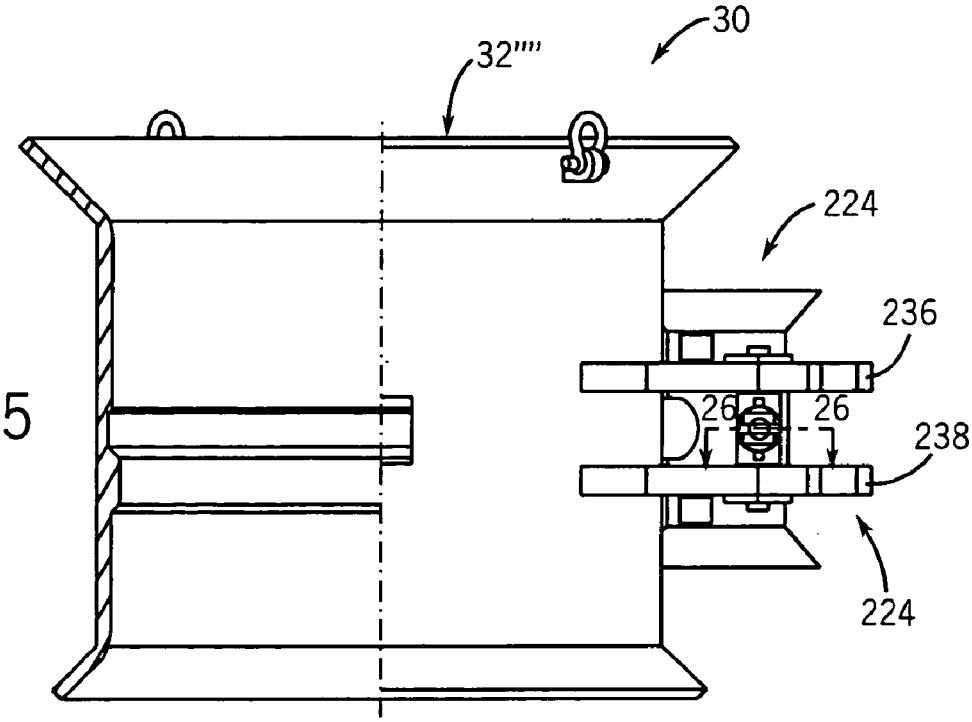
FIG. 25 is a side partial cross-sectional view of the keel guide system illustrated in FIG. 24.
Figure 26:
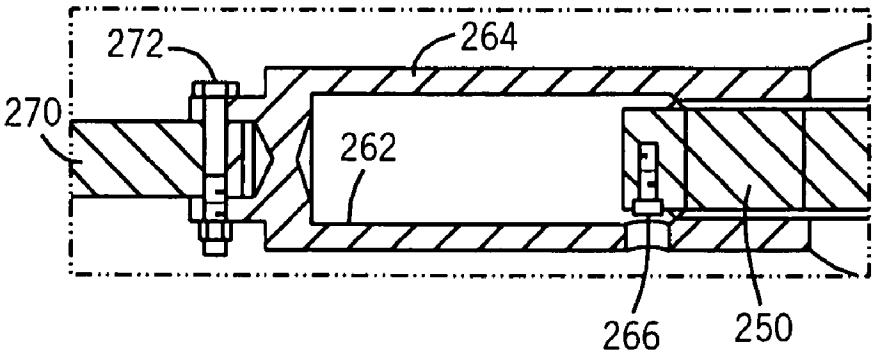
FIG. 26 is a cross-sectional view taken generally along line 26—26 of FIG. 25.
Figure 27:
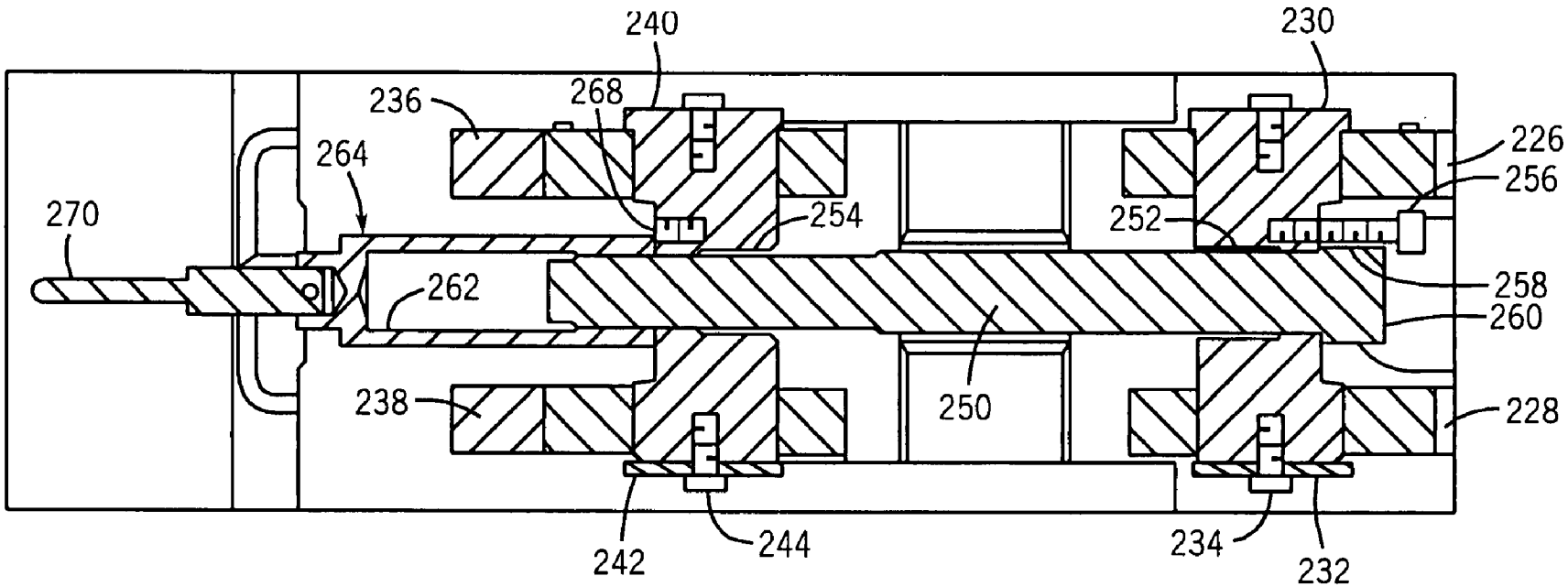
FIG. 27 is a cross-sectional view taken generally along line 27—27 of FIG. 24.

As illustrated in FIGS. 21 through 23, one exemplary type of pin assembly 190 comprises a body 192 having a bore or other type of opening 194 to slidably receive a lock-down pin 196. Lock-down pin 196 is biased radially outwardly by a spring 198 disposed within bore 194. Each lock-down pin 196 is retained in its corresponding bore 194 by a retaining screw 200.

Pin assemblies 190 may be mounted at a lower region of bushing 36 beneath a wear bushing assembly 202. Each pin assembly 190 may be coupled to the underside of wear bushing assembly 202 by sets of brackets and pins. For example, a pair of outer brackets 204 are attached to wear bushing assembly 202 at a radially outlying region by, for example, welding or other suitable attachment technique (see FIG. 22). A second set of brackets 206 are similarly attached below wear bushing assembly 202 radially inward from the set of brackets 204 (see FIG. 23). Body 192 is secured to the second, inward set of brackets 206 via a pin 208. Additionally, body 192 is secured to the first, radially outward set of brackets 204 via shear pins 210, which are threaded into outer brackets 204. An undercut 212 is formed, e.g. machined, to an underside of wear bushing assembly 202 proximate each second, radially inward set of brackets 206.

During deployment, bushing 36 is run into keel guide 32''' in a manner similar to that of the embodiments described above. When the wear bushing assembly 202 enters keel guide 32''', the outer end of each lock-down pin 196 contacts a tapered surface 214 formed along the interior surface of keel guide 32'''. The lock-down pins 196 ride against tapered surface 214 and are cammed inward into their corresponding bores 194 against the biasing force of the corresponding spring 198. As wear bushing assembly 202 is moved downwardly into keel guide 32''', the lock-down pins 196 are moved past tapered surface 214 and into proximity with a groove 216. The springs 198 force corresponding lock-down pins 196 outwardly into groove 216. An upper edge or shoulder 218 that defines the upper extent of groove 216 forms a locking taper with the lock-down pins 196. This prevents pins 196 from being cammed inward by moderate upwardly directed loads on the bushing 36.

If bushing 36 is to be retrieved, riser assembly 34 is raised until the installation clamps, e.g. clamp connector 154, contacts wear bushing assembly 202. When sufficient upward force is applied to bushing 36, shear pins 210 are sheared. This allows each pin assembly 190 to swing about pin 208 so the lock-down pin 196 clears groove 216. The undercut region 212 formed in wear bushing assembly 202 provides clearance for the pivoting of body 192. Upon retrieval of bushing 36, shear pins 210 may be replaced.

Another embodiment of keel guide system 30 is illustrated in FIGS. 24 through 27. In this embodiment, a keel guide 32'''' may be mounted to a structure, such as the hull of a vessel or platform. As with the embodiments described above, the inner diameter of keel guide 32'''' may be made large enough to allow passage of a connector, such as a tieback connector, or other component attached to the bottom of riser assembly 34. In this embodiment, keel guide 32'''' has a longitudinal side opening 222 that extends along the length of the keel guide. Side opening 222 allows the diameter of the keel guide to be increased and decreased a small amount by expanding and contracting, respectively, side opening 222. A locking device 224, such as a band-type locking device, is used to expand or contract side opening 222. An exemplary bushing 36 may be designed similar to that described with reference to FIGS. 2 and 5.

Locking device 224 comprises a first set of brackets 226 and 228 (see FIGS. 26 and 27) that are attached to an exterior of keel joint 32'''' by, for example, welding or other suitable attachment technique. The first set of brackets 26, 28 are located on one side of opening 222. A first pivot pin 230 is rotatably mounted in brackets 226, 228 and is retained by a suitable mechanism, such as a washer 232 and a screw 234.

A second set of brackets 236 and 238 are attached to the exterior of the keel joint, on a side of opening 222 opposite brackets 226, 228, by welding or other suitable technique. A second pivot pin 240 is rotatably mounted in brackets 236, 238 and is retained by an appropriate mechanism, such as a washer 242 and a screw 244. The first set of brackets 226, 228 is provided with notches, such as notches 246, and the second set of brackets 236, 238 is provided with comparable notches, such as notches 248 (see FIG. 24). Notches 246 and 248 are designed for engagement by an ROV clamping tool of the type used in subsea operations.

A stud 250 (see FIGS. 26 and 27) is disposed through a hole 252 in first pivot pin 230 and through a second hole 254 disposed through second pivot pin 240. The rotation of stud 250 is prevented by, for example, a screw 256 which engages a slot 258 in a head 260 of stud 250. The other end of stud 250 is threaded into a blind bore 262 of a locking device bushing 264. After stud 250 is threaded partially into bore 262, a retaining screw 266 is screwed transversely into the side of stud 250. Screw 266 prevents inadvertent separation of stud 250 from locking device bushing 264.

An open end 268 of locking device bushing 264 is disposed proximate to or bears on pivot pin 240 to prevent further separation of locking device 224. Opposite open end 268, locking device bushing 264 is attached to an actuator 270, such as a T-handle. The T-handle is attached via a fastener, such as a bolt 272. By way of example, actuator 270 may comprise a cross-bar 274 adapted to be gripped for rotation by an ROV tool.

To adjust locking device 224 and increase or decrease the effective diameter of the keel guide, notches 246, 248 are engaged by an ROV, and the two sides of the locking device are squeezed more closely together. Another ROV tool is then utilized to rotate actuator 270, e.g. a T-handle, to turn bushing 264 relative to stud 250. Depending on the direction of rotation, the distance between the head of stud 250 and locking device bushing 264 can be increased or decreased. Because the ROV is squeezing the locking device together, the spring force of keel guide 32'''' is not bearing on stud 250 and locking device bushing 264. Accordingly, a smaller amount of torque is required to rotate the locking device bushing 264.

Once the bushing 264 has been adjusted as desired, the ROV releases the sides of the locking device 224, and the keel guide expands to its adjusted diameter. Accordingly, the diameter of the keel guide can be decreased or increased to hold or release the bushing 36, as described with respect to the embodiment illustrated in FIGS. 2 and 5.

It should be understood that the foregoing description is of exemplary embodiments of this invention, and that the invention is not limited to the specific forms shown. For example, the keel guide system may be utilized in a variety of environments with a variety of riser assemblies; the size and shape of the keel guide may be adjusted depending on the size and shape of connectors or other components that pass through the keel guide; the configuration of the landing mechanisms, retention mechanisms and locking devices may be changed; and the size and configuration of various components can be adjusted according to a desired application. These and other modifications may be made in the design and arrangement of certain elements without departing from the scope of the invention as expressed in the appended claims.

What is claimed is:

1. A system for guiding a riser in an offshore environment, comprising:

a hull;

a keel guide attached to the hull;

a keel joint disposed within the keel guide; and a bushing mounted to the keel guide intermediate the keel joint and the keel guide, said bushing being releasably coupled to said keel joint, wherein said bushing is decoupled from said keel joint by relative vertical motion between said keel joint and said keel guide, said bushing comprising a plurality of wear inserts positioned to bear against the keel joint.

2. The system as recited in claim 1, wherein the bushing is releasably landed in the keel guide.

3. The system as recited in claim 1, wherein the bushing comprises a clamp connector to couple the bushing to the keel guide.

4. The system as recited in claim 2, wherein the keel guide comprises a plurality of lock-down assemblies to prevent inadvertent linear motion of the bushing relative to the keel guide.

5. The system as recited in claim 1, wherein the keel guide comprises a landing feature in the shape of a bowl.

6. The system as recited in claim 1, further comprising a wear sleeve external to the keel joint.

7. The system as recited in claim 1, wherein the bushing comprises a bushing member that acts against the keel joint, the bushing member having a wear coating.

8. A system for guiding a riser used in an offshore environment, comprising:

a keel guide having a landing feature, the landing feature being positioned to selectively hold a bushing mechanism, wherein the landing feature comprises at least one shoulder formed on an inner surface of said keel guide and an adjustable locking pin; and a keel joint slidably positioned within the bushing mechanism, said bushing mechanism allowing sliding movement of said keel joint within said bushing.

9. The system as recited in claim 8, further comprising a bushing releasably landed on the landing feature.

10. The system as recited in claim 8, further comprising a hull to which the keel guide is attached.

11. The system as recited in claim 8, wherein the landing feature comprises a pair of shoulders.

12. A method for guiding a riser, comprising:

releasably attaching a bushing to a riser assembly;

passing the riser assembly downward through a keel guide;

landing the bushing in the keel guide; and releasing the bushing from the riser assembly to permit linear movement of the riser assembly through the bushing.

13. The method as recited in claim 12, wherein releasing comprises fracturing a frangible connection.

14. The method as recited in claim 12, wherein landing comprises landing the bushing against a shoulder in the keel guide.

15. The method as recited in claim 12, wherein releasing comprises moving a keel joint of the riser assembly through the bushing.

16. The method as recited in claim 15, further comprising utilizing a plurality of bushing wear inserts to bear against the keel joint.

17. The method as recited in claim 12, further comprising passing a tieback connector through the keel guide.

18. A device for use with a riser in an offshore environment, comprising:

a bushing having a landing mechanism, the landing mechanism extending radially outward for engagement with a surrounding keel guide, wherein the bushing comprises a frangible connector for temporary coupling to a riser assembly.

19. The device as recited in claim 18, wherein the bushing comprises an opening in which a keel joint is slidably receivable.

20. A system for guiding a riser in an offshore environment, comprising:

a hull;

a keel guide attached to the hull;

a keel joint disposed within the keel guide; and a bushing mounted to the keel guide intermediate the keel joint and the keel guide, wherein the bushing comprises a retention mechanism having a plurality of spring-loaded pins that interact with the keel guide.

21. A system for guiding a riser in an offshore environment, comprising:

a hull;

a keel guide attached to the hull;

a keel joint disposed within the keel guide; and a bushing mounted to the keel guide intermediate the keel joint and the keel guide, wherein the bushing comprises a retention mechanism having a plurality of swinging lock-down pin assemblies.

22. A system for guiding a riser in an offshore environment, comprising:

a hull;

a keel guide attached to the hull;

a keel joint disposed within the keel guide; and a bushing positioned intermediate the keel joint and the keel guide, said bushing being releasably coupled to said keel joint by at least one frangible connection.

23. The system as recited in claim 22, wherein the bushing is releasably landed in the keel guide.

24. A system for guiding a riser in an offshore environment, comprising:

a keel guide having a landing feature, the landing feature being positioned to selectively hold a bushing, said keel guide having a side opening extending along a longitudinal length of said keel guide, said side opening allowing said keel guide to be opened and closed to increase or decrease, respectively, an effective internal diameter of said keel guide;

an actuating device that is adapted to open or close said opening; and a keel joint assembly slidingly positioned within said bushing.

25. The system as recited in claim 24, wherein the keel guide comprises a first internal shoulder positioned to engage the bushing and a second internal shoulder positioned to restrain the bushing against axial movement.

* * * * *